US006658674B2

(12) United States Patent
Bonelli et al.

(10) Patent No.: US 6,658,674 B2
(45) **Date of Patent: *Dec. 9, 2003**

(54) SELF-DRAINING SWIMMING POOL COVER

(75) Inventors: Jonathan J. Bonelli, New York, NY (US); Matthew P. Cowdell, Holtsville, NY (US); Mitchell Saccoccio, Lake Ronkonkoma, NY (US)

(73) Assignee: Stealth Industries, Ltd., Kowloon (CN)

( * ) Notice: Subject to any disclaimer, the term of this patent is extended or adjusted under 35 U.S.C. 154(b) by 0 days.

This patent is subject to a terminal disclaimer.

(21) Appl. No.: 10/308,044

(22) Filed: Dec. 2, 2002

(65) Prior Publication Data

US 2003/0079279 A1 May 1, 2003

Related U.S. Application Data

(63) Continuation-in-part of application No. 09/794,877, filed on Feb. 27, 2001, now Pat. No. 6,487,733.

(51) Int. Cl.[7] ..... E04H 4/00
(52) U.S. Cl. ..... 4/498
(58) Field of Search ..... 4/498, 499, 503; 428/131, 192

(56) References Cited

U.S. PATENT DOCUMENTS 1,057,654 A 4/1913 Menzel
3,184,764 A 5/1965 West
3,337,418 A 8/1967 Halacy, Jr.
4,233,695 A 11/1980 Rowney
4,281,422 A 8/1981 Simonelli
4,313,457 A 2/1982 Cliff
4,318,421 A 3/1982 Ward
4,450,855 A 5/1984 Hills
4,561,134 A 12/1985 Mathews et al.
4,633,899 A 1/1987 Lord
4,830,040 A 5/1989 Eng
4,843,658 A 7/1989 Hodak
5,259,078 A 11/1993 Crandall
5,594,960 A 1/1997 Stern
5,722,098 A 3/1998 Stern

*Primary Examiner*—Tuan N. Nguyen
(74) *Attorney, Agent, or Firm*—Dilworth & Barrese, LLP

(57) ABSTRACT

A drain assembly for a pool cover which includes a drain fitting positioned in a hole formed in the pool cover; a screen connected to the pool cover and positioned above the drain fitting to minimize the amount of debris entering the drain fitting; a buoyant barrier assembly connected to the pool cover adjacent to a perimeter of the screen to maintain a predetermined volume of water on the pool cover; and a flexible conduit connected at a first end to an outlet end of the drain fitting. A second end of the conduit is connected to an opening formed in a side of the pool. The barrier assembly includes a tubular shaped buoyant material housed within a pocket formed by two sections of material. The self-draining pool cover can also include floats for preventing portions of large pool covers from sagging into the water.

28 Claims, 7 Drawing Sheets

SELF-DRAINING SWIMMING POOL COVER

CROSS REFERENCE TO RELATED APPLICATIONS

The present application is a continuation-in-part of U.S. application Ser. No. 09/794,877 filed Feb. 27, 2001, which is now U.S. Pat. No. 6,487,733 to which priority is claimed, the disclosure of which is incorporated by reference herein.

BACKGROUND OF THE INVENTION

1. Field of the Invention

The present invention relates to a swimming pool cover and, more particularly, to a self-draining swimming pool cover.

2. Description of the Related Art

For years owners of swimming pools have had to deal with the problems associated with water collecting on the top of the pool cover when the pool is not in use. For example, the weight of an excessive amount of water may cause the cover to tear or it may cause damage to the sides of the pool. In colder climates, the water on the cover may freeze thereby compounding the problem. Also, the water that collects on top of the cover often becomes dirty or contaminated with algae, presenting an unsightly and unsanitary condition. If the cover tears, and upon removal of the cover from the pool, it is difficult to prevent the dirty water from entering the clean pool water. Therefore, while the cover is on the pool the owner is burdened with the continuing task of pumping or siphoning the water off of the cover.

Several attempts have been made to solve the problems associated with excessive accumulations of water on top of the pool cover. For example, U.S. Pat. No. 4,233,695 to Rowney and U.S. Pat. No. 5,259,078 to Crandall disclose swimming pool covers with rain water drainage and filter means. Although these patents adequately drain the water from the cover, the water within the pool becomes contaminated. Other designs offer solutions to the potential contamination problem resulting from allowing the water to drain into the pool. For example, U.S. Pat. No. 4,318,421 to Ward and U.S. Pat. No. 4,830,040 to Eng disclose float controlled siphon discharge valve mechanisms which operate to drain water from a swimming pool cover.

More simple designs are also in the prior art. For example, U.S. Pat. No. 3,184,764 to West discloses a swimming pool cover having a drain in the central portion thereof to drain all water off of the top of the pool cover. West '764 also discloses a screen installed over the drain opening to prevent leaves, dirt and other trash from clogging the drain opening. Additionally, U.S. Pat. No. 5,802,629 to Zeitek is also directed to a self-draining pool cover. Zeitek '629 includes a pool cover having an aperture with a drain fitting attached to the aperture positioned in a central portion of the pool cover. A flexible hose connects the drain fitting to an outlet assembly in the pool wall. A primary objective and feature of West '764 and Zeitek '629 patents is to drain all of the water off of the swimming pool cover. However, quite often it is desirable to maintain a predetermined amount of water on top of the pool cover to keep the pool cover from becoming damaged from flapping around in the wind.

Attempts have also been made to provide a self-draining pool cover with provisions to maintain a predetermined volume of water on top of the cover. For example, U.S. Pat. No. 4,819,681 to Hodak is directed to a method and apparatus for draining a swimming pool cover. In Hodak '681, the apparatus for draining a swimming pool cover includes a drainage device connected to a conduit which is connected to a discharge port fitting in the side of the pool. To maintain a predetermined amount of water on top of the pool cover, the drainage device also includes a vertical drain tube which extends upwardly a predetermined distance. Thus, the tube permits excess accumulated water at a level above the top edge of the drain tube to flow into the tube bore and drain through the conduit to be discharged from the pool.

However, notwithstanding the above advances in the art, a need still exists for a simple, self-draining swimming pool cover that fully drains all water surrounding the drain fitting while still maintaining a predetermined amount of water on top of the pool cover.

SUMMARY OF THE INVENTION

It is an object of the present invention to provide a simple, self-draining swimming pool cover that fully drains all water surrounding the drain fitting while still maintaining a predetermined amount of water on top of the pool cover.

One embodiment of the present invention is a drain assembly for a pool cover which includes a drain fitting positioned in a hole formed in the pool cover; a screen connected to the pool cover and positioned above the drain fitting to minimize the amount of debris entering the drain fitting; a barrier assembly connected to the pool cover adjacent to a perimeter of the screen to maintain a predetermined volume of water on the pool cover; and a flexible conduit connected at a first end to an outlet end of the drain fitting. A second end of the conduit is connected to an opening formed in a side of the pool.

The drain fitting includes a flange member and a nut. The flange member includes an upper circular ring with an elongate neck extending therefrom. The upper circular ring and elongate neck define an axial bore through the flange for draining water that passes through the screen. The elongate neck includes a plurality of threads on an outer periphery thereof for engaging threads formed on an inner circumference of the nut. The drain fitting may further include an elbow fitting connected to a lower end of the flange member to minimize any stress exerted by the conduit.

The barrier assembly includes a tubular shaped buoyant material housed within a pocket formed by two sections of material.

In another embodiment of the present invention, the drain assembly for a pool cover includes a drain fitting positioned in a hole formed in a section of material; a screen connected at its perimeter to the section of material such that at least a portion of the screen is positioned above the drain fitting to minimize the amount of debris entering the drain fitting; a barrier assembly connected to the section of material adjacent to a perimeter of the screen to maintain a predetermined volume of water on the pool cover; and a flexible conduit connected at a first end to an outlet end of the drain fitting. The section of material preferably has either a reflective surface or a black surface.

These and other objects, features and advantages of the present invention will become apparent from the following detailed description of illustrative embodiments, which is to be read in connection with the accompanying drawings.

BRIEF DESCRIPTION OF THE DRAWINGS

For a better understanding of the invention, reference is made to the following description of exemplary embodiments thereof, and to the accompanying drawings, wherein.

DETAILED DESCRIPTION OF PREFERRED EMBODIMENTS

The present disclosure describes a simple, self-draining swimming pool cover that fully drains all water surrounding the drain fitting while still maintaining a predetermined amount of water on top of the pool cover.

Figure 1:
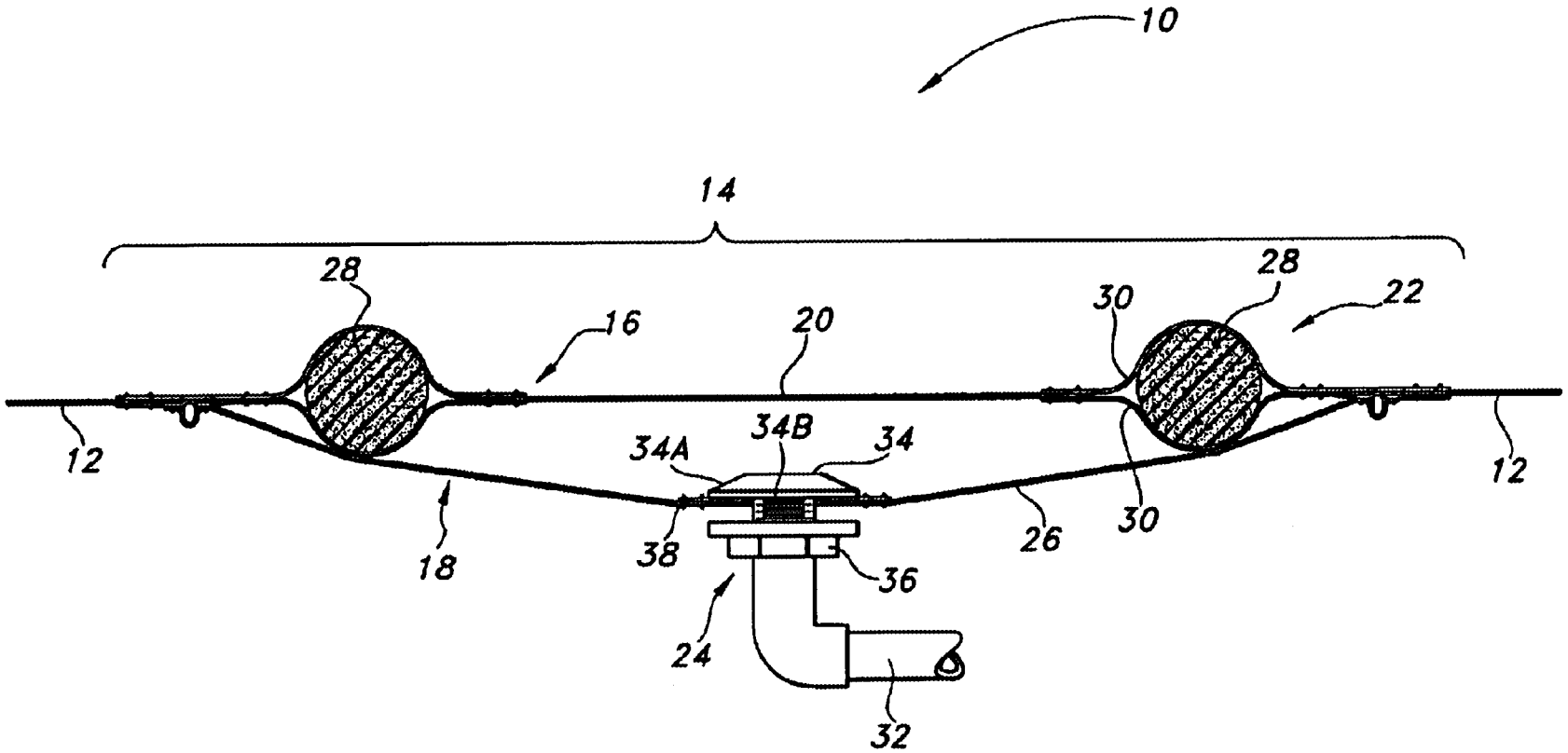
FIG. 1 is a side view illustrating a self-draining swimming pool cover in accordance with the present invention.

Referring now in specific detail to the drawings in which like reference numerals identify similar or identical elements throughout the several views, and initially to FIG. 1, one embodiment of a self-draining swimming pool cover constructed in accordance with the present disclosure is shown generally as self draining swimming pool cover 10.

Self-draining swimming pool cover 10 includes a pool cover 12 having a drain assembly 14 connected thereto. Drain assembly 14 includes a first layer 16 and a second layer 18. First layer 16 includes a screen portion 20 and a barrier assembly 22. Second layer 18 includes a drain fitting 24 positioned within a section of material 26.

Pool cover 12 is preferably formed of a vinyl or other flexible plastic water impervious material. The peripheral edge regions (not shown) of the pool cover 12 are affixed to the perimeter of a swimming pool by weights, clamps or the like, all in a manner known to one having ordinary skill in the art.

Screen portion 20 constitutes the center portion of first layer 16 and is provided to prevent leaves, sticks and other debris from blocking the bore of drain fitting 24 while allowing water to pass therethrough. Also, since the screen 20 will allow water to pass therethrough, any debris remaining on top of the screen will be held out of contact with the water. Therefore, the debris will not become or remain water-logged and will not mat down so as to clog the screen and prevent the flow of water therethrough. Eventually, the debris will blow away with the wind thereby leaving the screen as well as the rest of the cover clean and free of dirt and debris.

Barrier assembly 22 ensures that a volume of water remains on the cover to assist in keeping the cover in position during windy weather. Barrier assembly 22 is preferably formed by placing a buoyant material 28, such as Styrofoam® brand foamed polymer, within a pocket formed by two sections of cover material 30 and is attached to the cover 12 around the perimeter of the screen 20. Buoyant material will ensure that the cover 12 floats above the water level in the pool thereby creating a barrier between the cover 12 and the drain assembly 14. The pocket is preferably formed by attaching two sections of cover material together by stitching, welding or any other means known to one having ordinary skill in the art. An opening may be left in the pocket to facilitate the insertion of material 28 afterwards, or the pocket may be formed around material 28. Screen 20 and cover 12 are connected on either side of barrier assembly 22 by sandwiching the screen 20 and cover 12 between the two sections of cover material 30 and holding them in place by stitching.

Second layer 18 may be attached directly to pool cover 10 or it may be attached to first layer 16, either by stitching or another means known to one having ordinary skill in the art. Material 26 is preferably the same material that is used to fabricate cover 12. However, in colder climates, it is preferred that material 26 has an upper surface that is either silver in color and reflective, or a dark color such as black. The purpose of having either a reflective surface or a dark colored surface is to create an area which will be warmer than the surrounding area due to the absorption of the radiant energy of the sun. Accordingly, this area will tend to be less susceptible to the formation of ice around drain fitting 24.

Drain fitting 24 defines an opening positioned in a portion of the cover (preferably the central portion). A reinforcing patch 38 is preferably attached to the pool cover at the location at which drain fitting 24 will be installed. A lower end of drain fitting 24 is connected to a first end of a conduit 32 for discharging water which enters the opening in the drain fitting. Typically, a hose clamp will be employed to facilitate the connection between the drain fitting and the conduit. A second end of the conduit may be connected to an opening in a side of the swimming pool, a pump, or the pool's filter system (not shown). Conduit 32 is preferably formed of a flexible hose to maintain the required flexibility in the event that the pool cover rises and falls with the level of water in the pool. It is also preferable to connect an elbow 34 to the lower end of drain fitting 24 to facilitate easier connection of conduit 32 and to reduce the amount of stress placed on the drain fitting by conduit 32.

Drain fitting 24 includes a flange 34 and a nut 36. The flange 34 includes a substantially flat upper circular ring with an elongate neck extending therefrom. The upper ring 34A has a diameter which is greater than a diameter of the neck 34B. The upper ring 34A and the elongate neck 34B together define an axial bore through flange 34.

The elongate neck 34B includes a plurality of threads on an outer periphery thereof. Nut 36 is configured and dimensioned having threads on an inner surface to threadably engage the elongate neck 34B. Thus, when nut 36 is threaded onto the elongate neck 34B it is tightened against the upper ring 34A of flange 34 and drain fitting 24 is secured to material 26.

Alternatively, nut 36 may be secured to flange 34 by another means such as epoxy, welding, an interference fit or any other means known to one having ordinary skill in the art. Two rubber gaskets may be placed over the elongate neck 34B on either side of material 26 to prevent leakage into the pool when nut 36 is tightened against the upper ring 34A of flange 34.

During manufacture of the self-draining pool cover in accordance with the present invention, the elongate neck of flange 34 is inserted into a hole formed in a pool cover from an upper surface of the pool cover. Alternatively, the elongate neck 34B of flange 34 may be installed through a hole formed in a separate section of material 26 wherein the section of material 26 is subsequently connected to a larger opening in pool cover 12. From below the pool cover, nut 36 is then screwed on to the portion of the elongate neck 34B which extends through the cover, to lock the cover between the nut and the upper ring of flange 34. Conduit 32 is then connected to a lower portion of drain fitting 24. Barrier assembly 22 and screen portion 20 are then attached to cover 12 in a location to overlay the drain fitting.

Figure 2:
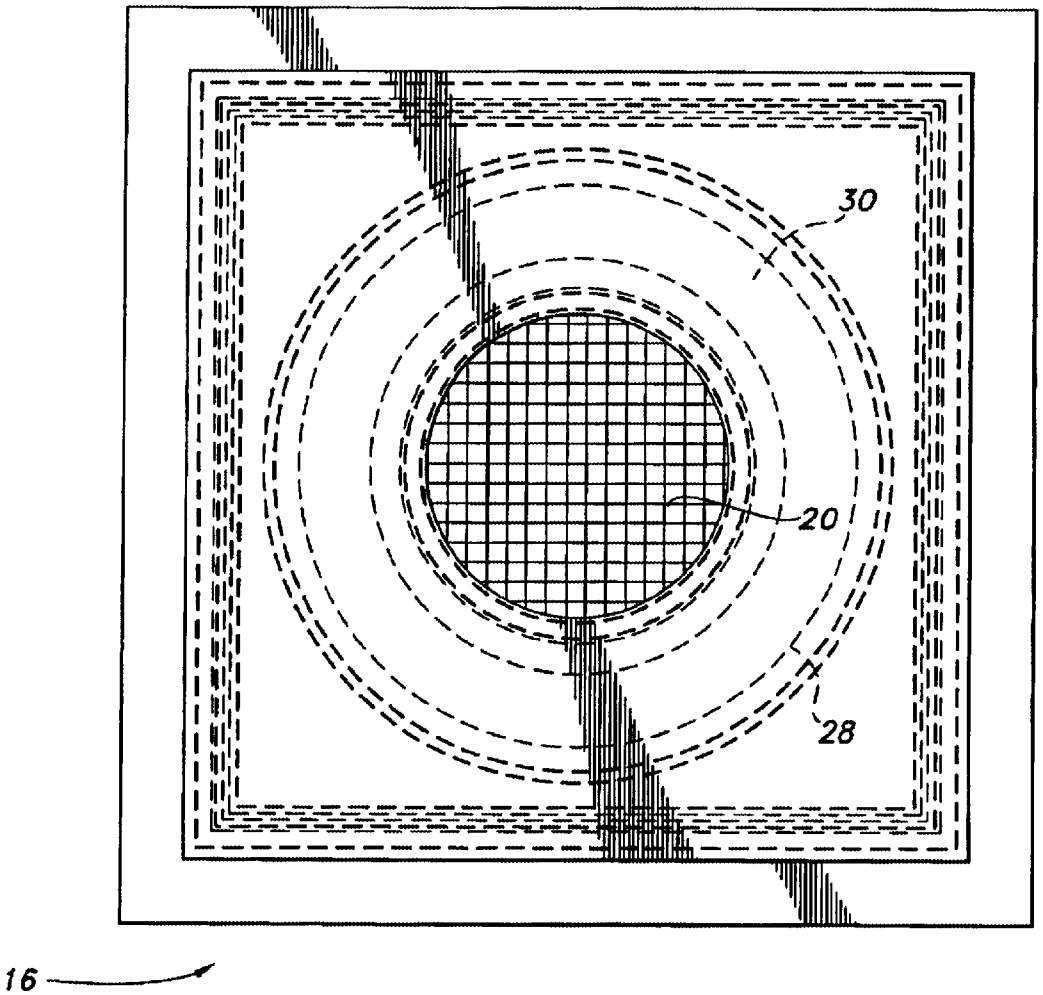
FIG. 2 is a top view illustrating a first layer of the self-draining swimming pool cover in accordance with the present invention.

Referring now to FIG. 2, a top view of the first layer 16 of the self draining swimming pool cover in accordance with the present invention is illustrated. As shown, screen 20 forms the central portion of first layer 16. As represented by the dashed lines around the perimeter of screen 20, screen 20 is attached to two sections of cover material 30 by stitching. Although shown in a circular configuration, screen 20 may be a square, triangle or any other shape. Screen 20 is preferably approximately twenty-four inches in diameter.

Adjacent to the outer circumferential periphery of screen 20 is barrier assembly 22, which includes, as discussed above, buoyant material 28 housed within two sections of cover material 30. Again, as represented by the dashed lines, the two sections of cover material 30 are stitched together to house buoyant material 28 therebetween.

The resulting first layer 16 may then be attached within a cut-out in a pool cover by stitching first layer 16 to the pool cover, as represented in FIG. 2, by the dashed lines around the perimeter of first layer 16. The solid line illustrated adjacent to the perimeter of first layer 16 represents the preferred location at which second layer 18 is attached to first layer 16.

Figure 3:
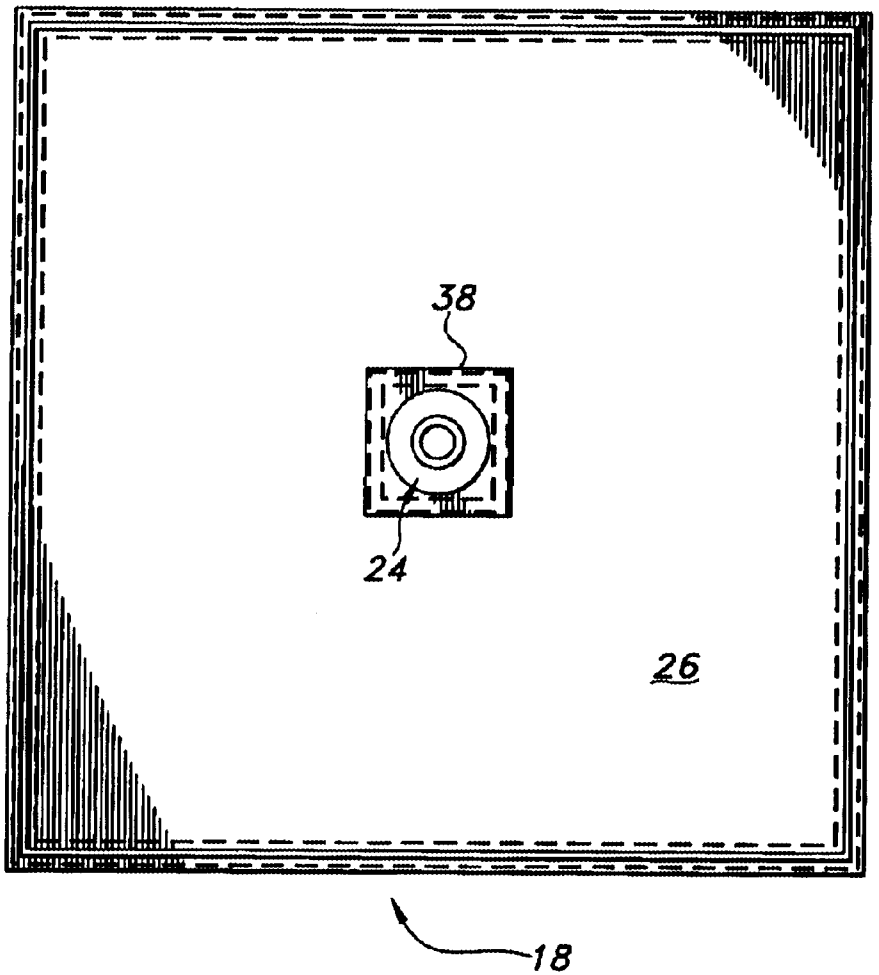
FIG. 3 is a top view illustrating a second layer of the self-draining swimming pool cover in accordance with the present invention.

Referring now to FIG. 3, a top view of the second layer 18 of the self draining swimming pool cover in accordance with the present invention is illustrated. As illustrated, a reinforcement patch 38 is attached to a central portion of material 26 by stitching, epoxy or any other means known to one having ordinary skill in the art. A hole is then formed through material 26 and reinforcement patch 38 and drain fitting 24 is installed through the hole. The solid line illustrated adjacent to the perimeter of second layer 18 represents the preferred location at which second layer 18 is attached to first layer 16.

Figure 4:
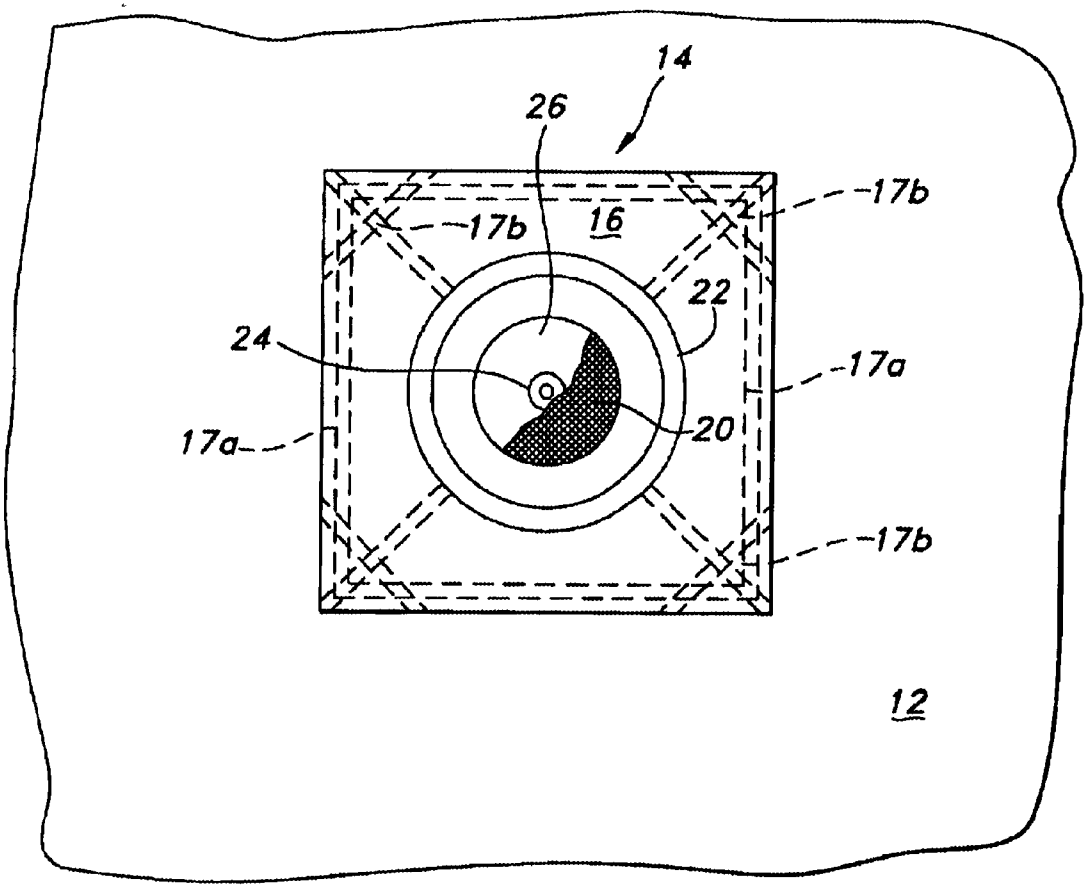
FIG. 4 is a plan view of the pool cover with the drain assembly.

Referring now to FIG. 4, pool cover 12 includes a drain assembly 14 having a first layer 16 stitched thereto. Buoyant barrier assembly 22 includes a buoyant material secured therein as explained above. The buoyant material can be closed cell polymer foam (e.g., Styrofoam® brand), or a buoyant polymer rope. The ends of the rope are brought together and joined by, for example, heat or solvent welding to form a ring. Sheet metal material 26 and drain fitting 24 are covered by mesh 20 which prevents leaves and other debris from entering the drain fitting 24. Sheet material 26 is preferably metallized (e.g., with aluminum) to provide at least a partially reflective surface. First layer 16 is preferably stitched to pool cover 12 by means of peripheral double-line stitching 17*a*. As added reinforcement, and to prevent the formation of air bubbles between first layer 16 and the pool cover, X-shaped double stitching 17*b* at the corners of the first layer are used to secure the first layer 16.

Figure 5:
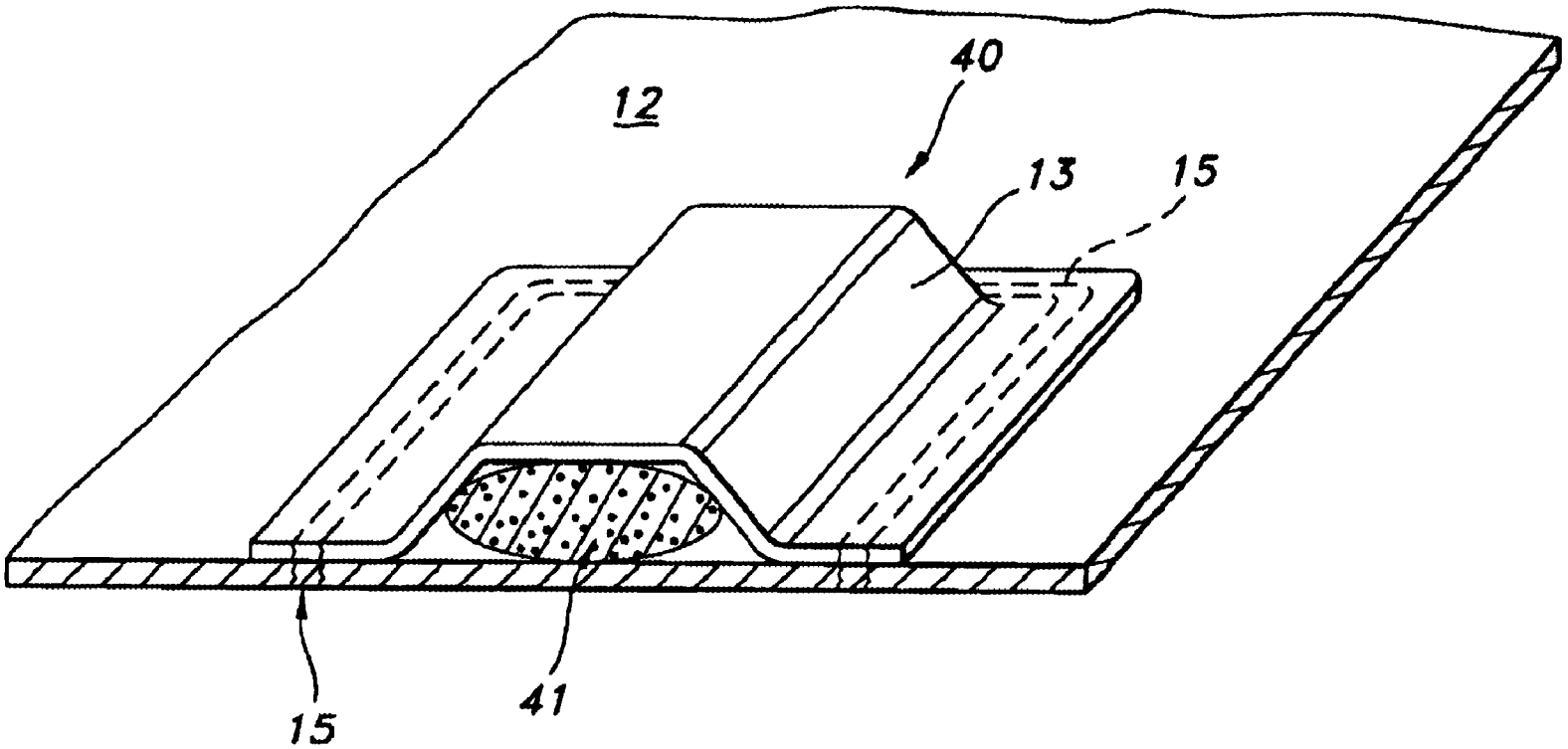
FIG. 5 is an isometric sectional view illustrating a float.
Figure 6:
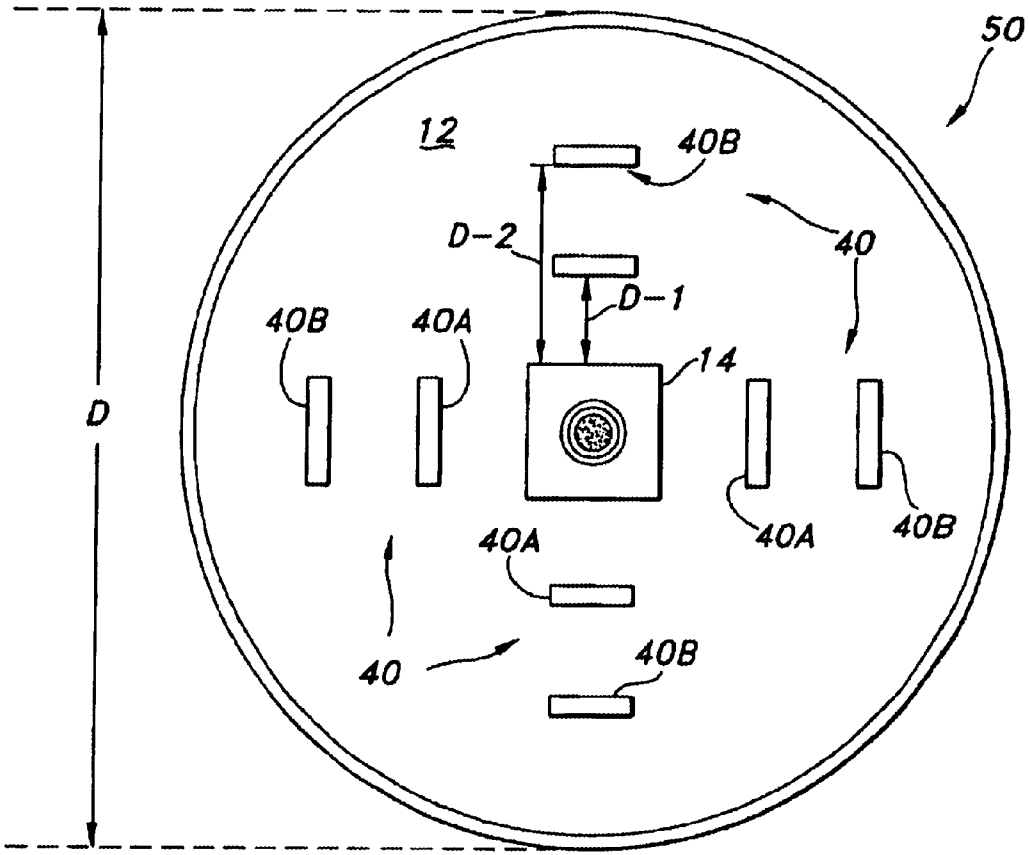
FIGS. 6 and 7 are plan views of the pool cover showing additional float arrangement.
Figure 7:
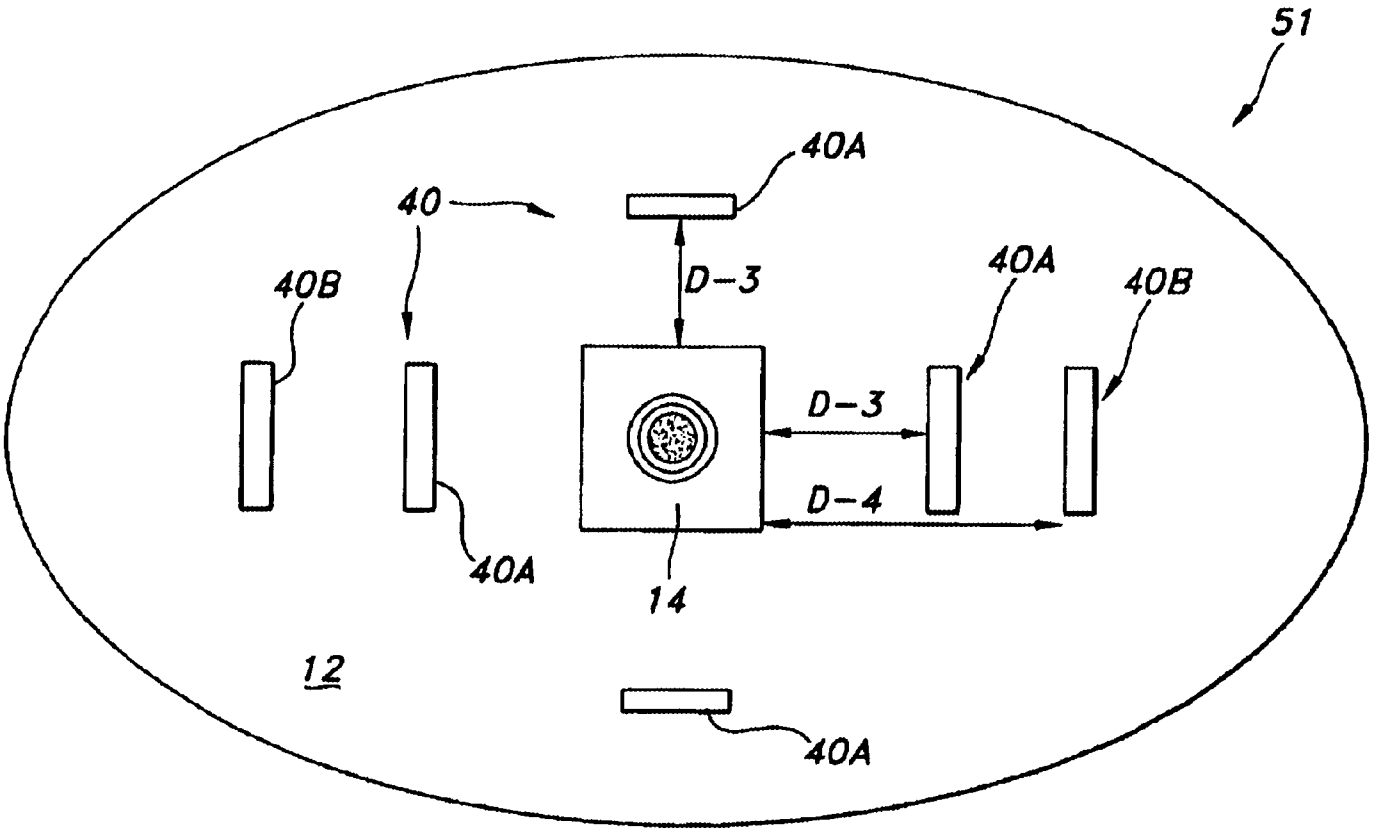

Referring now to FIGS. 5, 6, and 7, additional floats can be incorporated into the pool cover to maintain buoyancy across the pool cover 12. Additional floats are advantageous for large size pool covers to prevent portions of the cover from sagging and accumulating pockets of water.

Referring to FIG. 5, a sewn-in float 40 includes a buoyant material 41 secured to the top surface of pool cover 12 by cover material 13 which is attached to pool cover 12 by peripheral stitching 15. Buoyant material 41 can be any suitable material such as polymeric foam (e.g. Styrofoam® brand) or any material or object having a density less than water. Cover material 13 can be the same material as pool cover 12 and is preferably a polymer sheet. Stitching 15 is preferably double stitching.

Referring particularly now to FIG. 6, a circular self-draining swimming pool cover 50 is shown which includes a pool cover 12*a* drain assembly 14 and a plurality of floats 40. Preferably, at least four inner floats 40A are symmetrically arranged as opposite pairs such that imaginary lines between each pair together form a cross. The four inner floats 40A are each equidistant from the respective edge of the drain assembly 14 by a distance D-1. Depending upon the size of the pool cover, a second set of outer floats 40B may optionally also be included in the self draining swimming pool cover 50. Floats 40B are positioned outward from and in alignment with corresponding inner floats 40A in a symmetrical cross-like configuration. Outer floats 40B are each equidistant from the respective edge of the drain assembly 14 by a distance D-2.

By way of illustration, the following Table I sets forth exemplary distances for various pool cover diameters D.

TABLE 1

| POOL COVER DIAMETER D | D-1 | D-2 |
|---|---|---|
| 8 feet | No floats 40A | No floats 40B |
| 12–15 feet | 24 inches | No floats 4GB |
| 18–21 feet | 36 inches | No floats 4GB |
| 24–27 feet | 36 inches | 72 inches |

Referring now to FIG. 7, oval shaped self draining swimming pool cover 51 with floats 40 is illustrated wherein inner floats 40A are spaced from the drain assembly 14 a distance D-3 and optional outer floats 40B are spaced apart from the drain assembly 14 a distance D-4. The outer floats 40B are generally only positioned, if needed, along the major axis of the pool cover 12. Typically, for pool covers ranging in size from about 10'×16' to about 12'×18' (smaller distance is the length of the minor diameter, larger distance is the major diameter) only floats 40A are needed and D-3 is approximately 24 inches distance between inner floats 40A and the drain assembly 14.

For pool covers ranging in size from about 12'×24' to about 16'×25', floats 40A and 40B are included wherein D-3 is about 24" and D-4 is about 48".

Although the illustrative embodiments of the present invention have been described herein with reference to the accompanying drawings, it is to be understood that the invention is not limited to those precise embodiments, and that various other changes and modifications may be affected therein by one having ordinary skill in the art without departing from the scope or spirit of the invention. For example, the pool cover can have as many floats as are necessary to accomplish the functions described above. Moreover, the floats can be positioned in diagonal or other arrangement in addition to, or instead of, along the major and minor axes of the pool cover. The pool cover can be any suitable shape such as circular, oval, quadrangular, triangular, and the like. Accordingly, the invention is not limited by the number and arrangement of the floats or the shapes of the pool cover as illustrated by the embodiments described herein. All variations and modifications are intended to be included within the scope of the invention as defined by the appended claims.

What is claimed is:

1. A drain assembly for a pool cover comprising:

a drain fitting positioned in a hole formed in the pool cover;

a screen connected to the pool cover and positioned above the drain fitting to minimize the amount of debris entering the drain fitting; and a buoyant barrier assembly having a buoyant material connected to the pool cover to maintain a predetermined volume of water on the pool cover.

2. The drain assembly for a pool cover as recited in claim 1 further comprising a conduit connected at a first end to an outlet end of the drain fitting and at a second end of the conduit to an opening formed in a side of the pool.

3. The drain assembly for a pool cover as recited in claim 2 wherein the conduit is flexible.

4. The drain assembly for a pool cover as recited in claim 1 wherein the barrier assembly is connected to the pool cover adjacent to a perimeter of the screen.

5. The drain assembly for a pool cover as recited in claim 1 wherein the drain fitting includes a flange member and a nut.

6. The drain assembly for a pool cover as recited in claim 5 wherein the flange member includes an upper circular ring with an elongate neck extending therefrom.

7. The drain assembly for a pool cover as recited in claim 6 wherein the upper circular ring and elongate neck define an axial bore through the flange for draining water that passes through the screen.

8. The drain assembly for a pool cover as recited in claim 6 wherein the elongate neck includes a plurality of threads on an outer periphery thereof for engaging threads formed on an inner circumference of the nut.

9. The drain assembly for a pool cover as recited in claim 5 wherein the drain fitting further includes an elbow fitting connected to a lower end of the flange member.

10. The drain assembly for a pool cover as recited in claim 1 wherein the drain fitting is positioned in a center of the pool cover.

11. The drain assembly for a pool cover as recited in claim 1 wherein the screen is substantially flat.

12. A drain assembly for a pool cover comprising:

a drain fitting positioned in a hole formed in a section of material;

a screen connected at its perimeter to the section of material such that at least a portion of said screen is positioned above the drain fitting to minimize the amount of debris entering the drain fitting; and a buoyant barrier assembly having a buoyant material connected to the section of material adjacent to a perimeter of the screen to maintain a predetermined volume of water on the section of material.

13. The drain assembly for a pool cover as recited in claim 12 further comprising a conduit connected at a first end to an outlet end of the drain fitting.

14. The drain assembly for a pool cover as recited in claim 13 wherein the conduit is flexible.

15. The drain assembly for a pool cover as recited in claim 14 wherein the drain fitting includes a flange member and a nut.

16. The drain assembly for a pool cover as recited in claim 15 wherein the flange member includes an upper circular ring with an elongate neck extending therefrom.

17. The drain assembly for a pool cover as recited in claim 12 wherein the section of material has a reflective surface.

18. The drain assembly for a pool cover as recited in claim 12 wherein the section of material has a black surface.

19. The drain assembly for a pool cover as recited in claim 12 wherein the section of material is attached to a pool cover in a center region of the pool cover.

20. The drain assembly for a pool cover as recited in claim 12 wherein the screen is substantially flat.

21. A self-draining pool cover comprising:

a) a pool cover having a hole formed therein;

b) a drain fitting positioned in the hole in the pool cover;

c) a screen connected to the pool cover and positioned above the drain fitting;

d) a buoyant barrier assembly having a buoyant material connected to the pool cover to maintain a predetermined volume of water on the pool cover; and, e) a plurality of floats attached to the pool cover and spaced apart from the drain fitting.

22. The self-draining pool cover of claim 21 wherein the plurality of floats comprises at least a first array of floats, the floats of the first array being spaced apart from the drain fitting at a first distance.

23. The self-draining pool cover of claim 22 wherein the plurality of floats comprises a second array of floats, the floats of the second array being spaced apart from the drain fitting at a second distance, wherein the second distance is greater than the first distance.

24. The self-draining pool cover of claim 23 wherein the first array comprises four floats.

25. The self-draining pool cover of claim 24 wherein the second array comprises four floats.

26. The self-draining pool cover of claim 21 wherein the floats are each enclosed within a respective enclosed pocket formed by the pool cover and a sheet of material attached to the pool cover.

27. The self-draining pool cover of claim 26 wherein each float comprises a foamed polymeric material.

28. The self draining pool cover of claim 21 wherein the screen is substantially flat.

* * * * *